US008496822B2

(12) United States Patent
Schoell et al.

(10) Patent No.: US 8,496,822 B2
(45) Date of Patent: Jul. 30, 2013

(54) RETAINING DEVICE, ESPECIALLY FOR FLAT ROOF DRAINS

(75) Inventors: Maximilian Schoell, Thansau (DE); Michael Zimmermann, Wasserburg (DE)

(73) Assignees: GmbH Koch Kunststofftechnologie (DE); Hans Juergen Koch (DE)

( * ) Notice: Subject to any disclaimer, the term of this patent is extended or adjusted under 35 U.S.C. 154(b) by 260 days.

(21) Appl. No.: 12/919,372

(22) PCT Filed: Feb. 25, 2009

(86) PCT No.: PCT/EP2009/001341

§ 371 (c)(1), (2), (4) Date: Nov. 16, 2010

(87) PCT Pub. No.: WO2009/106315

PCT Pub. Date: Sep. 3, 2009

(65) Prior Publication Data

US 2011/0049036 A1 Mar. 3, 2011

(30) Foreign Application Priority Data

Feb. 27, 2008 (DE) ..... 20 2008 002 772 U

(51) Int. Cl.

| | |
|---|---|
| ***E04D 13/00*** | (2006.01) |
| ***E04D 13/04*** | (2006.01) |
| ***B01D 35/02*** | (2006.01) |

(52) U.S. Cl.
USPC ..... 210/232; 210/163; 210/459; 210/474; 52/12

(58) Field of Classification Search
USPC ..... 210/232, 163, 459, 474; 52/12
See application file for complete search history.

(56) References Cited

U.S. PATENT DOCUMENTS

| | | | | |
|---|---|---|---|---|
| 864,884 | A * | 9/1907 | Capaldi | 210/463 |
| 1,746,683 | A * | 2/1930 | Schifter | 4/287 |
| 2,800,231 | A * | 7/1957 | Hicks | 210/463 |
| 5,469,670 | A | 11/1995 | Thaler | |
| 6,165,357 | A | 12/2000 | Cormier | |
| 6,330,724 | B1 | 12/2001 | Belle | |

OTHER PUBLICATIONS

May 15, 2009 International Search Report for PCT/EP2009/001341.

* cited by examiner

*Primary Examiner* — Thomas M Lithgow
(74) *Attorney, Agent, or Firm* — Bliss McGlynn, P.C.

(57) ABSTRACT

A retaining device 1 comprises a cup-shaped trap basket 2 including a circular support edge 3. A holder 4 is disposed at the trap basket 2, includes at least two holding arms 5, 6 movable between a "holding position" and "release" position, and is a separate assembly adapted to be connected to the trap basket 2. A gear unit 8 includes a bolt 10 that is adapted to be connected with a rotatable operating element 7 and has a driving worm 9 and tooth sections 11 adapted to be engaged with the driving worm 9 and disposed at the holding arms 5, 6.

8 Claims, 1 Drawing Sheet

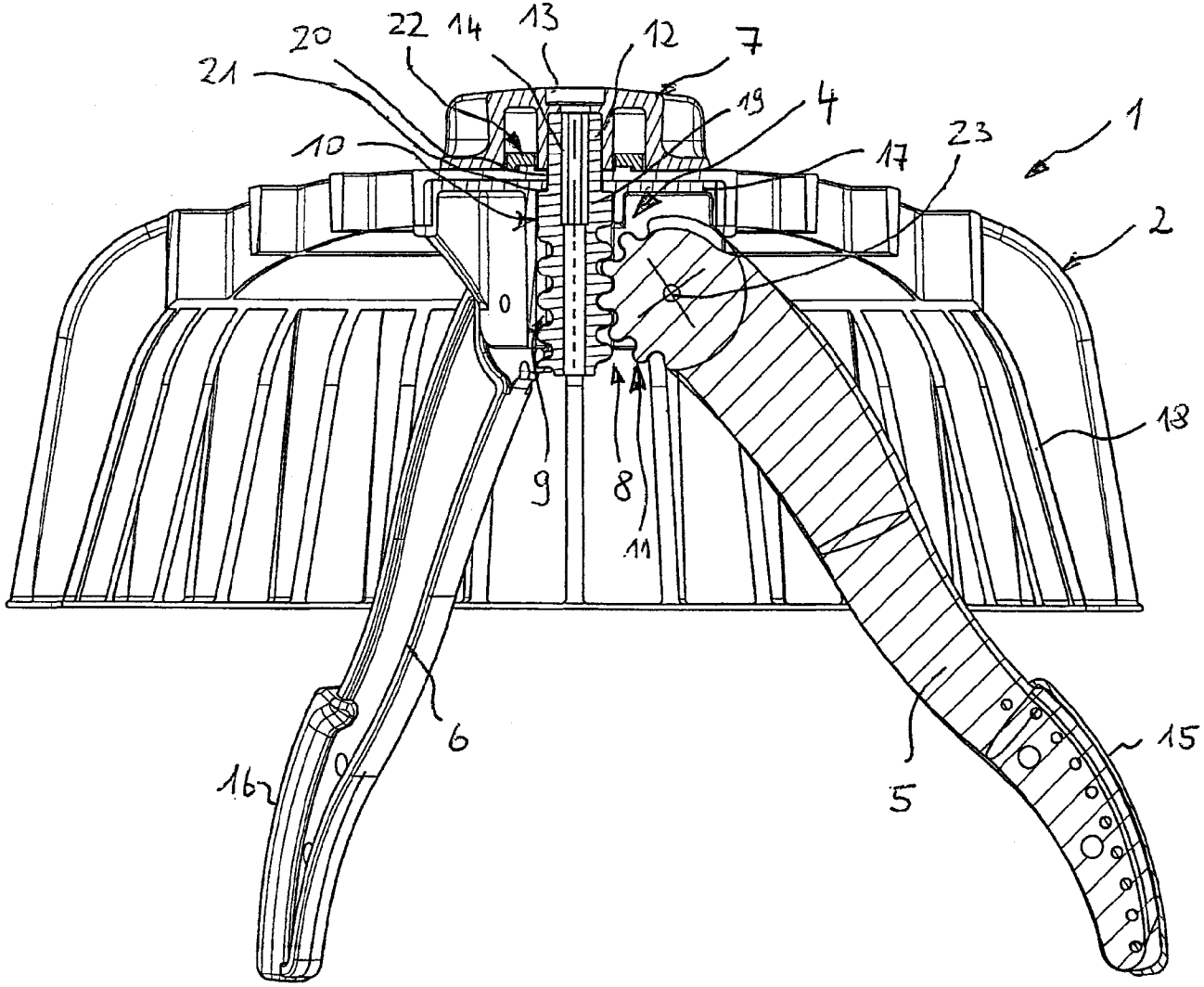
1
2
18
15
23
17
4
19
7
12
13
14
22
20
21
10
5
8
11
9
6
16

RETAINING DEVICE, ESPECIALLY FOR FLAT ROOF DRAINS

CROSS-REFERENCE TO RELATED APPLICATION

This application claims, under 35 U.S.C. §365, priority to and benefit of the filing date of PCT Application PCT/EP2009/001341, which, in turn, claims benefit of German Patent Application 202008002772.1 filed on Feb. 27, 2008 and entitled "Retaining Device, Especially for Flat Roof Drains."

BACKGROUND OF INVENTION

1. Field of Invention

The invention relates, generally, to a retaining device and, more particularly, to such a device used especially for flat-roof drains.

2. Description of Related Art

A known retaining device covering a drain of a roof, in general, and a flat roof, in particular, is used to prevent infiltration of the drain by pollution—such as debris, gravel, leaves, and other possibly blocking materials. Hence, in practice, such retaining device is often designated as a "gravel-trap basket" or "leaves-trap basket."

For this purpose, the known retaining device comprises a cup-shaped trap basket provided, in general, with rib units that are able to drain water, but can retain polluting materials, such as leaves, gravel, or the like. The trap basket has a support edge, is set to a roof region that encircles the drain, and is removably attached by a bracket. For this purpose, holding arms protruding into the drain are typically provided.

The known retaining device is integrally provided with holding arms that are spread into a "holding" position due to their resiliency, wherein the holding arms must be compressed for assembly and placed in the drain. However, this construction results in the disadvantage that suitably adapted ones of the known retaining device need to be manufactured for different respective applications so that the known retaining device is of little flexibility.

Thus, there is a need in the related art for a retaining device of a drain of a roof, in general, and a flat roof, in particular, that is more flexible. More specifically, there is a need in the related art for suitably adapted ones of a retaining device that do not need to be manufactured for different respective applications.

SUMMARY OF INVENTION

The invention overcomes the disadvantages in the related art in a retaining device comprising a cup-shaped trap basket including a circular support edge. A holder is disposed at the trap basket, includes at least two holding arms movable between a "holding" position and "release" position, and is a separate assembly adapted to be connected to the trap basket. A gear unit includes a bolt that is adapted to be connected with a rotatable operating element and has a driving worm and tooth sections adapted to be engaged with the driving worm and disposed at the holding arms.

One advantage of the retaining device of the invention is that it is extremely flexible.

Another advantage of the retaining device of the invention is that suitably adapted ones of it do not need to be manufactured for different respective applications.

Another advantage of the retaining device of the invention is that the holder constitutes a separate assembly that is connected to the trap basket only when the retaining device is assembled on a roof.

Another advantage of the retaining device of the invention is that it provides a completely modular design thereof in a simple way.

Another advantage of the retaining device of the invention is that it comprises components adapted to be pre-fabricated as standard elements—like the trap basket in different sizes and the adapted holder—and combined with each other in a modular way.

Another advantage of the retaining device of the invention is that it is beneficial in its manufacturing.

Another advantage of the retaining device of the invention is that it is adapted to be assembled in a simple way at a place of installation of the retaining device.

Another advantage of the retaining device is that it provides step-less adjustability of holding forces of the retaining device, even at different sizes of a drain.

Other objects, features, and advantages of the retaining device of the invention will be readily appreciated as the same becomes better understood while reading the subsequent description of an embodiment of the retaining device taken in conjunction with the accompanying drawing thereof.

BRIEF DESCRIPTION OF FIGURE OF DRAWING

FIG. 1 is a side view of an embodiment of a retaining device according to the invention for covering a drain of a roof, in general, and a flat roof, in particular, to prevent infiltration of the drain by pollution.

DETAILED DESCRIPTION OF EMBODIMENT OF INVENTION

Referring now to FIG. 1 (hereinafter referred to as "the FIGURE"), an embodiment of a retaining device of the invention is generally indicated at 1. The retaining device 1 is adapted to be used with a drain (not shown) of a roof (not shown), in general, and a flat roof, in particular. However, it should be appreciated by those having ordinary skill in the related art that the retaining device 1 is not limited to such use. It should be so appreciated also that the drain can be any suitable drain and the roof can be any suitable roof.

Still referring to the FIGURE, the retaining device 1 comprises, in general, a cup-shaped trap basket 2 including a circular support edge 3. A holder 4 is disposed at the trap basket 2, includes at least two holding arms 5, 6 movable between a "holding" position and a "release" position, and is a separate assembly adapted to be connected to the trap basket 2. A gear unit 8 includes a bolt 10 that is adapted to be connected with a rotatable operating element 7 and has a driving worm 9 and tooth sections 11 adapted to be engaged with the driving worm 9 and disposed at the holding arms 5, 6.

More specifically, the trap basket 2 is provided with a plurality of ribs 18 spaced with respect to each other. Thus, the trap basket 2 can be penetrated by water whereas pollution—such as stones, gravel, leaves, or the like—can be retained by the ribs 18.

To set the trap basket 2 to the drain, the holder 4 can be releaseably connected to the trap basket 2. For this purpose, the holder 4 includes the operating element 7 in the form of, for example, a turning knob equipped with handle parts with which the holding arms 5, 6 of the holder 4 are adapted to be pivoted between the retracted "release" or "assembling" position and the spread "holding" position.

The operating element 7 is provided with the gear unit 8 for this purpose. The bolt 10 of the gear unit 8 is equipped with the driving worm 9 at an end of the bolt 10 that, in the "assembling" position, is protruding into the trap basket 2. The holding arms 5, 6 have tooth sections 11 only one of which of the holding arm 5 is visible in the FIGURE. As can be seen in the FIGURE, in the "assembled" position, tooth section 11 of the holding arm 5 as well as the non-visible tooth section 11 of the holding arm 6 are engaged with the driving worm 9. The holding arms 5, 6 are supported pivotably at a cup-shaped insert element 17 so that the holding arms 5, 6 are adapted to be pivoted from the "release" position to the "holding" position.

A holding section 19 as well as a passing section 12 of the bolt 10, which passes upwardly through a recess 21 of the insert element 17 and a recess 20 of the trap basket 2, are attached upwardly to the driving worm 9. Hence, the operating element 7 can be sheathed over the passing section 12 and connected to the bolt 10 through a recess 13 by a screw thread. Therefore, the separate holder 4 can be connected to the trap basket 2 in a simple way.

Further, a snap 22 is able to be constructed as, for example, a disk or panel configuration with teeth having different helix angles on both flanks of the teeth. The snap 22 is spring-loaded and rotated by operating the operating element 7 so that the meshed teeth disposed on the disk and opposite face of the trap basket 2 are engaged and, thus, able to fix the holding position of the holder 4 additionally. To still enhance a holding effect, the holding arms 5, 6 are equipped with adhering pads 15, 16 that can be formed as clipped-on additional elements or connected integrally to corresponding free-end sections of the holding arms 5, 6.

The holder 4 can be independently handable as well. Accordingly, the holder 4 can be combined with the retaining device 1, as previously described, or other assembly parts to be mounted on the roof, such as cover hoods for venting of the roof. So, the holder 4 can be built of any combination of single parts of the holder 4 previously described.

The retaining device 1 is extremely flexible. Also, suitably adapted ones of the retaining device 1 do not need to be manufactured for different respective applications. And, the holder 4 constitutes a separate assembly that is connected to the trap basket 2 only when the retaining device 1 is assembled on the roof. Furthermore, the retaining device 1 provides a completely modular design of the retaining device 1 in a simple way. In addition, the retaining device 1 comprises components adapted to be pre-fabricated as standard elements—like the trap basket 2 in different sizes and the adapted holder 4—and combined with each other in a modular way. Moreover, the retaining device 1 is beneficial in its manufacturing. Plus, the retaining device 1 is adapted to be assembled in a simple way at a place of installation of the retaining device 1. The retaining device 1 provides step-less adjustability of holding forces of the retaining device 1, even at different sizes of the drain, as well.

An embodiment of the retaining device 1 has been described above in an illustrative manner. It is to be understood that the terminology that has been used above is intended to be in the nature of words of description rather than of limitation. Many modifications and variations of the retaining device 1 are possible in light of the above teachings. Therefore, within the scope of the claims below, the retaining device 1 may be practiced other than as specifically described above.

What is claimed is:

1. A retaining device (1) comprising:

a cup-shaped trap basket (2) including a circular support edge (3);

a holder (4) disposed at said trap basket (2), including at least two holding arms (5, 6) movable between a "holding" position and "release" position, and being a separate assembly adapted to be connected to said trap basket (2); and a gear unit (8) including a bolt (10) that is adapted to be connected with a rotatable operating element (7) and has a driving worm (9), wherein each of said holding arms (5, 6) has a tooth section (11) adapted to be engaged with said driving worm (9).

2. A retaining device (1) as set forth in claim 1, wherein said holder (4) includes said operating element (7).

3. A retaining device (1) as set forth in claim 1, wherein said operating element (7) has a spring-loaded snap (22).

4. A retaining device (1) as set forth in claim 1, wherein said holding arms (5, 6) are spaced with respect to each other by 180°.

5. A retaining device (1) as set forth in claim 1, wherein said holding arms (5, 6) have adhering pads (15, 16) at free ends of said holding arms (5, 6).

6. A retaining device (1) as set forth in claim 5, wherein said adhering pads (15, 16) are clipped on said free ends of said holding arms (5, 6).

7. A retaining device (1) as set forth in claim 6, wherein said adhering pads (15, 16) are integrally connected to said free ends of said holding arms (5, 6).

8. A retaining device comprising: a cup-shaped trap basket including a circular support edge;

a holder disposed at said trap basket, including at least two holding arms movable between a "holding" position and "release" position, and being a separate assembly adapted to be connected to said trap basket;

a gear unit including a bolt that is adapted to be connected with a rotatable operating element and has a driving worm and tooth sections adapted to be engaged with said driving worm and disposed at said holding arms; and wherein said operating element has a spring-loaded snap being annular shaped and located in an annular space of said operating element and abutting a top of said trap basket and having a mechanism to fix the holding position of said holder.

* * * * *

UNITED STATES PATENT AND TRADEMARK OFFICE

CERTIFICATE OF CORRECTION

PATENT NO. : 8,496,822 B2
APPLICATION NO. : 12/919372
DATED : July 30, 2013
INVENTOR(S) : Schoell et al.

It is certified that error appears in the above-identified patent and that said Letters Patent is hereby corrected as shown below:

On the title page, following Item (73), "Assignees:" insert therefor --b/s/t--.

Signed and Sealed this
Twenty-fourth Day of December, 2013

Margaret A. Focarino

Margaret A. Focarino
*Commissioner for Patents of the United States Patent and Trademark Office*